US007712332B2

(12) United States Patent
Wright

(10) Patent No.: US 7,712,332 B2
(45) Date of Patent: May 11, 2010

(54) PENDANT STABILIZATION DEVICE

(75) Inventor: Stephen G. Wright, 968 Birnam Woods Trails, Indianapolis, IN (US) 46280

(73) Assignee: Stephen G. Wright, Indianapolis, IN (US)

( * ) Notice: Subject to any disclaimer, the term of this patent is extended or adjusted under 35 U.S.C. 154(b) by 848 days.

(21) Appl. No.: 11/528,761

(22) Filed: Sep. 28, 2006

(65) Prior Publication Data

US 2008/0078206 A1 Apr. 3, 2008

(51) Int. Cl.
*A44C 5/00* (2006.01)

(52) U.S. Cl. ..... 63/3; 63/4; 63/13; 63/21; 63/23

(58) Field of Classification Search ..... None
See application file for complete search history.

(56) References Cited

U.S. PATENT DOCUMENTS 2,416,034 A * 2/1947 Weed ..... 63/3.1

* cited by examiner

*Primary Examiner*—Jack W. Lavinder
(74) *Attorney, Agent, or Firm*—Krieg DeVault LLP

(57) ABSTRACT

An apparatus comprises a bearing, a pendant, and a supporting component. The bearing rotatably engages the pendant. The supporting component engages a portion of the bearing. The bearing rotates relative to the pendant upon movement of the supporting component with respect to the pendant and the bearing to maintain the alignment of the pendant.

28 Claims, 8 Drawing Sheets

PENDANT STABILIZATION DEVICE

BACKGROUND

The present invention relates to stabilization devices, and more particularly, but not exclusively, relates to pendant stabilization devices that maintain the alignment of a pendant when the element supporting the pendant is moved with respect to the pendant.

In certain pendants, it is desirable to maintain the alignment of a pendant when the component supporting the pendant is moved with respect to the pendant. While various pendant stabilization devices have been developed, in certain applications there is still room for improvement. Thus, a need persists for further contributions in this area of technology.

SUMMARY

One embodiment of the present invention includes a unique pendant stabilization device. The pendant stabilization device comprises a pendant, a supporting component, and a bearing. The bearing rotatably engages the pendant body. The supporting component engages a portion of the bearing and causes the bearing to rotate with respect to the pendant body when the supporting component is moved with respect to the pendant body and bearing. Other embodiments include unique apparatus, devices, systems, and methods to stabilize the orientation of a pendant. Further embodiments, forms, objects, features, advantages, aspects, and benefits of the present application shall become apparent from the detailed description and figures included herewith.

DETAILED DESCRIPTION OF SELECTED EMBODIMENTS

Figure 1:
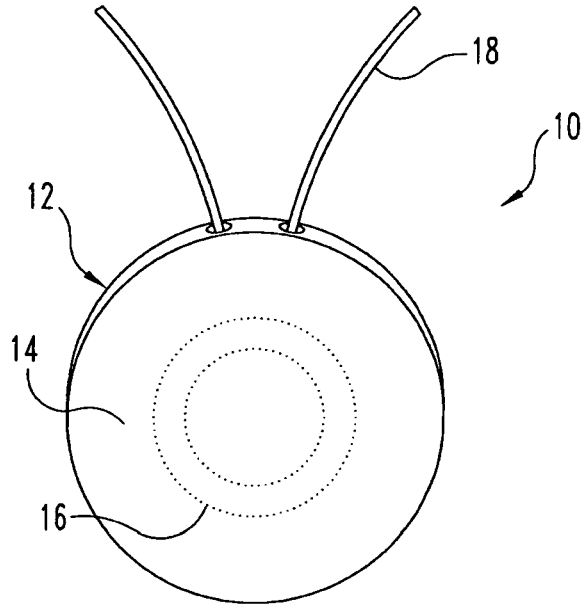
FIG. 1 is a front view of the pendant stabilization device according to one embodiment of the current invention.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments and any further applications of the principles of the invention as described herein are contemplated as would normally occur to one skilled in the art to which the invention relates.

Referring now to the figures, FIG. 1 illustrates a pendant stabilization device 10 according to one embodiment of the current invention. The pendant stabilization device 10 comprises a pendant 12 with a pendant body 14, a bearing 16, and a supporting component 18 that supports the pendant 12. The pendant 12 may be solid and composed of metal. In other embodiments, the pendant body 14 may be hollow, have passages therethrough, have openings and/or channels therein, and may be a stone, a crystal, a jewel, plastic, metal, glass, an image, a time piece, a vial containing liquids, powders, gems, stones, or other such materials or items.

The bearing 16 may rotatably engage the pendant body 14 and may be positioned within the pendant body 14. In other embodiments, the bearing 16 may be rotatably coupled to the outside of the pendant body 14; fixedly coupled to the outside of the pendant body 14; fixedly coupled within the pendant body 14; or be part of the pendant body 14. The bearing 16 may be a concavely shaped pulley. In other embodiments, the bearing 16 may include ball bearings, be a ball bearing kit, be a flat pulley, or other rotatable bearings.

The supporting component 18 may engage a portion of the bearing 16 and cause the bearing 16 to rotate with respect to the pendant body 14 when the supporting component 18 is moved with respect to the pendant body 14 and bearing 16. In one embodiment, the supporting component 18 frictionally engages a portion of the bearing 16. In another embodiment, the bearing 16 may remain stationary and the supporting component 18 may slide along the surface of the bearing 16. In yet another embodiment, the bearing 16 may have protrusions (not shown) that engage the supporting component 18. The supporting component 18 may be made of plastic, metal, or thread and may be a chain, a cord, at least one strand, a rope, a ribbon, a tie, or other similar components for supporting.

Figure 2:
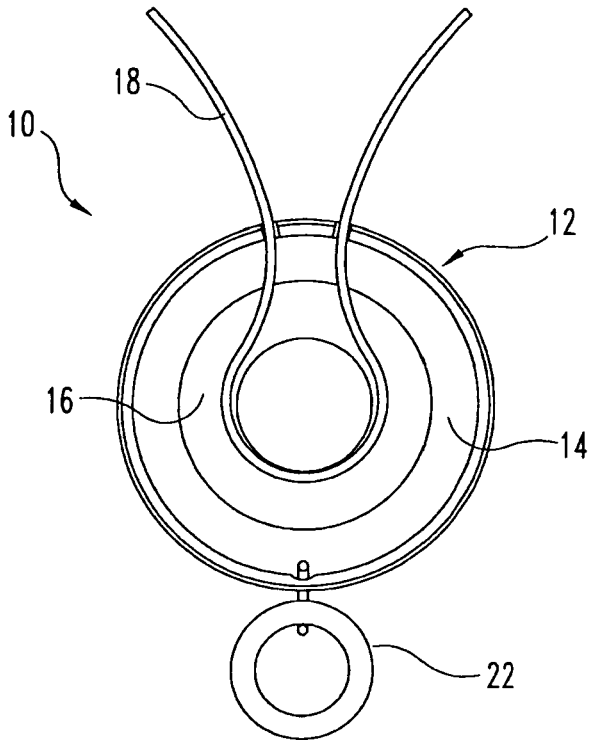
FIG. 2 is a front cross-sectional view of the pendant stabilization device of FIG. 1.
Figure 3:
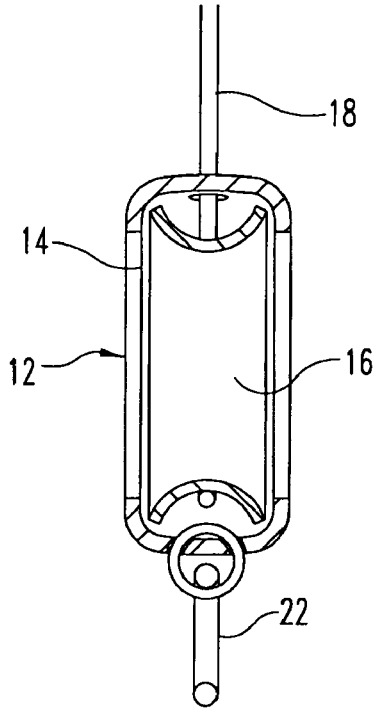
FIG. 3 is a side cross-sectional view of the pendant stabilization device of FIG. 1.

FIGS. 2 and 3 show the pendant stabilization device 10 including a weight 22 to facilitate the retention and return of the pendant 12 to a desired position. The weight 22 may be coupled with any surface of the bearing 16 and/or pendant body 14 in order to facilitate the desired positioning of the pendant 12.

Figure 4:
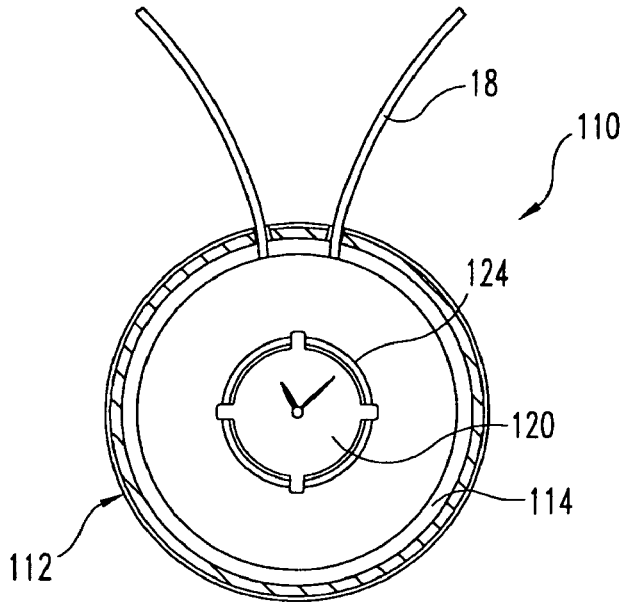
FIG. 4 is a front view of the pendant stabilization device according to another embodiment of the current invention.
Figure 5:
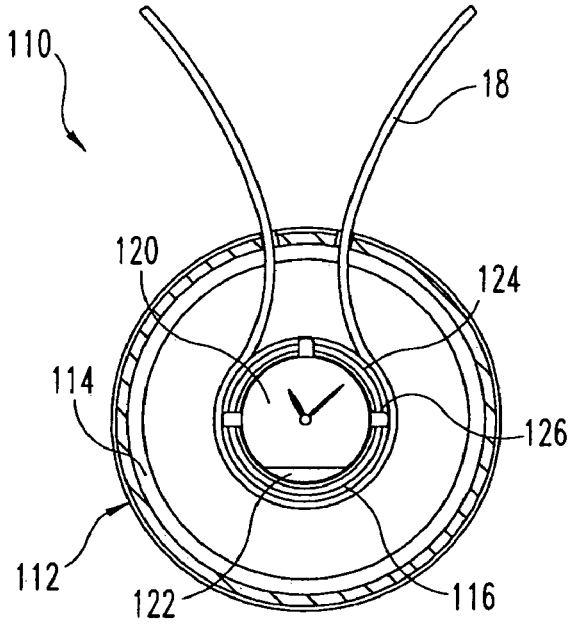
FIG. 5 is a front cross-sectional view of the pendant stabilization device of FIG. 4.

FIGS. 4 and 5 illustrates a pendant stabilization device 110 according to another embodiment of the current invention. The pendant stabilization device 110 comprises a pendant 112 with a pendant body 114, a bearing 116, a supporting component 18 that supports the pendant 112, and a decorative element 120. The pendant body 114 may include a passage 124 therein or therethrough to retain the decorative element 120 and/or the bearing 114 therein. In one embodiment, the pendant body 114 includes a passage 124 therethrough that receives the decorative element 120 and a retaining element 126 that couples with the decorative element 120 to retain the decorative element 120 within the passage 124. In another embodiment, the pendant body 114 includes a passage 124 therein that receives the decorative element 120 and a retaining element 126 that couples with the decorative element 120 to retain the decorative element 120 within the passage 124. In still another embodiment, the bearing 116 receives the decorative element 120 and rotatably engages a passage 124 within the pendant body 114. In yet another embodiment, the bearing 116 receives the decorative element 120 and rotatably engages a passage 124 through the pendant body 114.

The decorative element 120 may be a time piece. In other embodiments, the decorative element 120 may be a stone, a crystal, a jewel, plastic, metal, glass, a picture or image, time pieces, a vial containing liquids, powders, gems, stones, embellishments on the surface of the pendant 112 and/or bearing 116 such as etchings, cloisonné, engraving, and filigree, or other such embellishments or ornamentation. See FIGS. 13A-D. The decorative element 120 may have a weight 122 coupled therewith. In one embodiment, the decorative element 120 may be or may act as the weight 122. In other embodiments, the decorative element 120 may not have the weight 122 coupled therewith.

Figure 6:
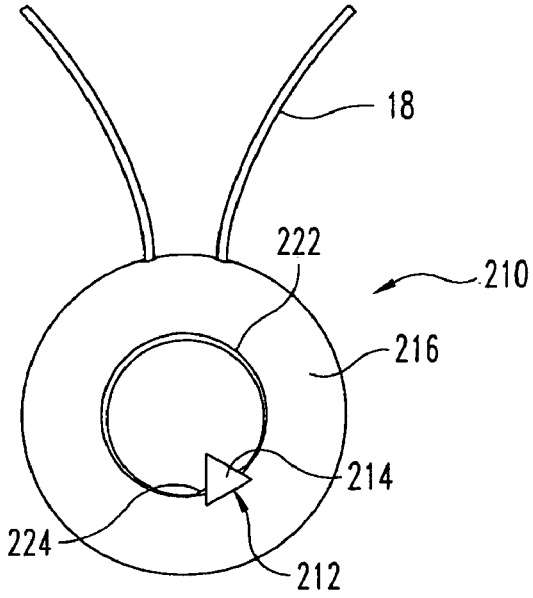
FIG. 6 is a front view of the pendant stabilization device according to another embodiment of the current invention.
Figure 7:
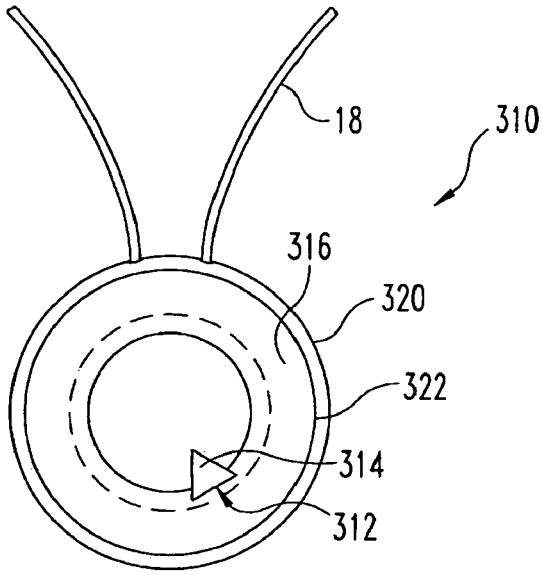
FIG. 7 is a front view of the pendant stabilization device of FIG. 6.

FIG. 6 illustrates a pendant stabilization device 210 according to yet another embodiment of the current invention. The pendant stabilization device 210 may include a pendant 212 having a pendant body 214, a supporting component 18 that supports the pendant 212, and a bearing 214 with a passage 222 in which the pendant 212 is positioned. In other embodiments, the pendant stabilization device 210 may also include a decorative element (not shown). The bearing 214 may have a passage 222 therein that receives the pendant 212 and a retaining element 224 that retains the pendant 212 therewithin. In another embodiment, the bearing 214 has a passage 222 therethrough that receives the pendant 212 and a retaining element 224 that retains the pendant 212 therewithin. The pendant 212, shown here as a solid stone, may be in the form of various embellishments varying in size and material. The bearing 214 may have uniform side surfaces. In other embodiments, the bearing 214 may have non-uniform side surfaces.

Figure 8:
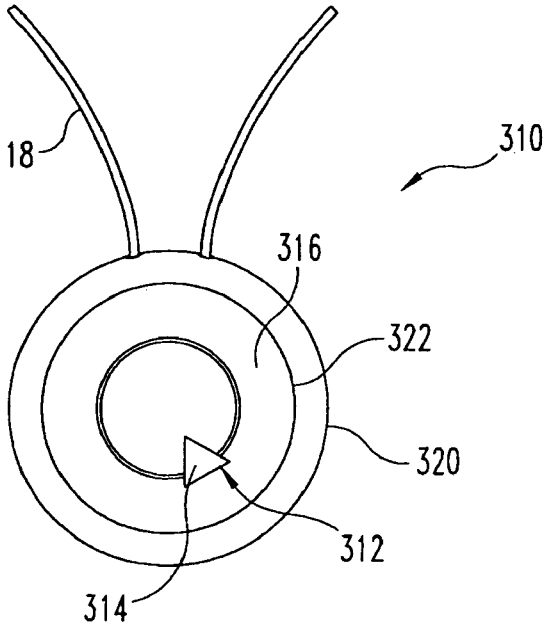
FIG. 8 is a front view of the pendant stabilization device according to another embodiment of the current invention.
Figure 9:
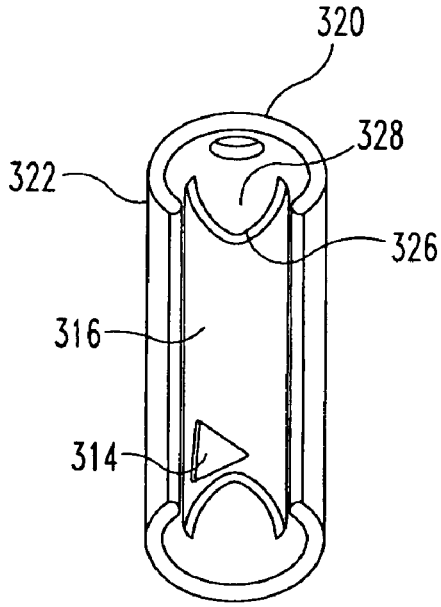
FIG. 9 is a side cross-sectional view of the pendant stabilization device as shown in FIG. 8.
Figure 11:
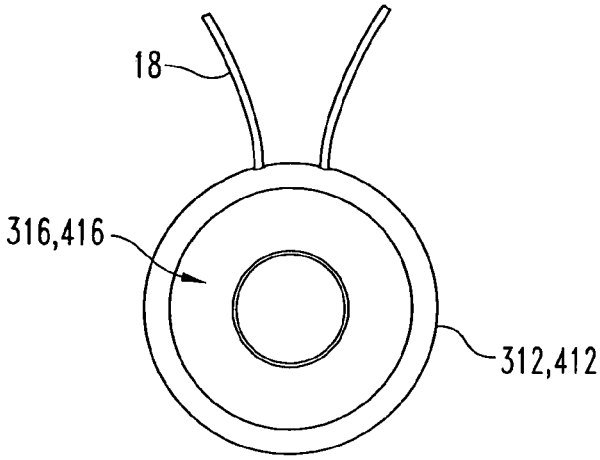
FIG. 11 is a front view of the pendant stabilization device according to another embodiment of the current invention.
Figure 12A:
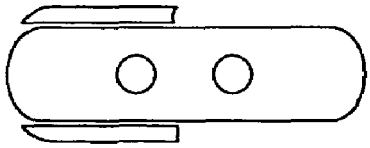
FIG. 12A&B are side views of the pendant stabilization device according to another embodiment of the current invention.
Figure 12B:
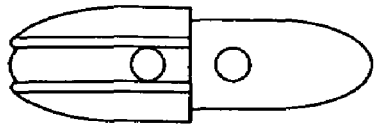
Figure 13A:
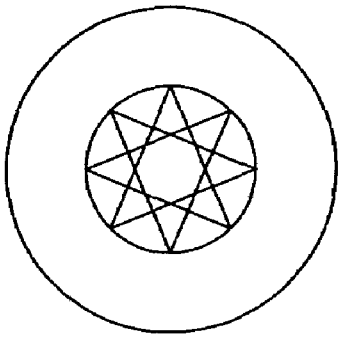
FIG. 13A-E are front perspective views of the pendant stabilization device according to another embodiment of the current invention.
Figure 13B:
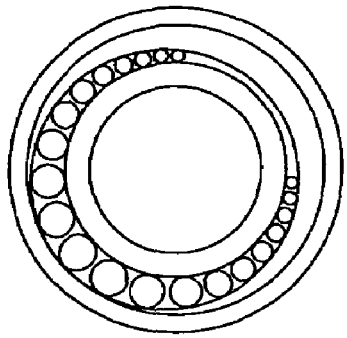
Figure 13C:
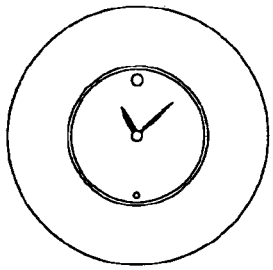
Figure 13D:
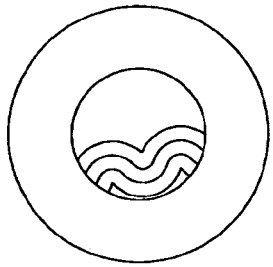
Figure 13E:
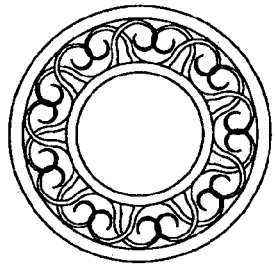

FIGS. 8 and 9 illustrate the pendant stabilization device 310 according to still another embodiment of the current invention. The pendant stabilization device 310 may include a pendant 312, a supporting component 18, and a bearing 316 in which an outer band 320 wraps around the edges 322 of the bearing 316 to create a non-uniform surface. In other embodiments, the pendant stabilization device 310 may also include a decorative element 120. The degree of deviation between the non-uniform surfaces may range from negligible to a very distinct or decorative feature. In one embodiment, the outer band 320 is one of a pointed and rounded shape as depicted in FIGS. 12A&B. The supporting component 18 may rest mainly within a concave surface 326 of the bearing 316 and may be contained within a cavity 328 between the outer band 320 and the bearing 316. The pendant 312 and/or the bearing 316 may rotate freely from the outer band 320 as depicted in FIG. 11.

Figure 10:
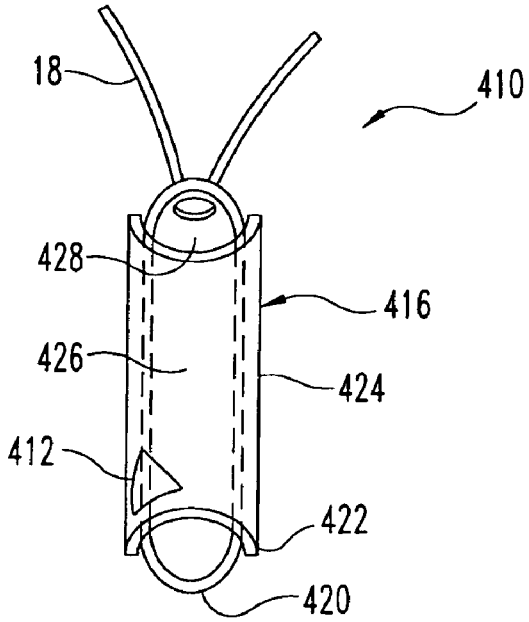
FIG. 10 is a side cross-sectional view of the pendant stabilization device according to another embodiment of the current invention.

FIG. 10 illustrates a pendant stabilization device 410 according to still another embodiment of the current invention. The pendant stabilization device 410 may include a pendant 412, a supporting component 18, and a bearing 416 which is encircled by an outer band 420. In other embodiments, the pendant stabilization device 410 may also include a decorative element (not shown). The bearing 416 and outer band 420 may not be permanently coupled in a fixed point of reference. The outer band 420 may be shaped and sized to remain at the outer edges 422 of the bearing sides 424. In one embodiment, the outer band 420 is one of a pointed and rounded shape as depicted in FIGS. 12A&B. The supporting component 18 may rest primarily on the internal surfaces 426 of the bearing 416 and may be contained within a cavity 428 between the outer band 420 and the bearing 416. The pendant 412 and/or the bearing 416 may rotate freely from the outer band 420 as depicted in FIG. 11.

Figure 10A:
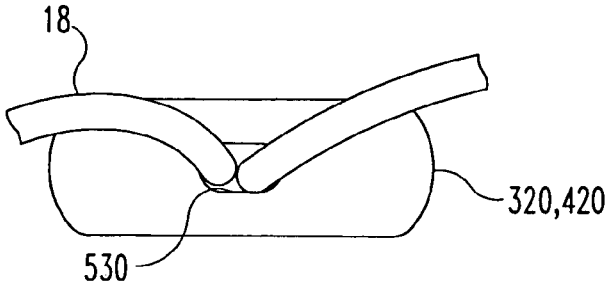
FIG. 10A&B are top views of pendant stabilization device of FIG. 10.
Figure 10B:
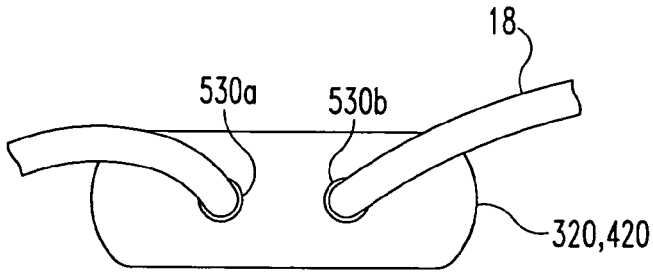

FIGS. 10A&B depict alternatives for the supporting component 18 to be drawn through the outer band 320, 420. In one embodiment, the supporting component 18 may be drawn through a single opening 530 in the outer band 320, 420. In another embodiment, the supporting component 18 may be drawn through openings 530*a*, 530*b* in the outer band 320, 420.

Figure 14:
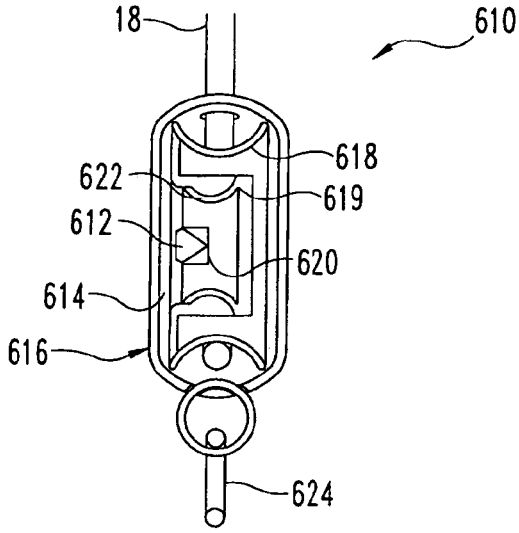
FIG. 14 is a side cross-sectional view of the pendant stabilization device according to another embodiment of the current invention

FIG. 14 illustrates a pendant stabilization device 610 according to still another embodiment of the current invention. The pendant stabilization device 610 may include a pendant 612 with a pendant body 614, a bearing 616 having an outer bearing 618 and an inner bearing 619, and a supporting component 18 for supporting the pendant 612 and bearing 616. In other embodiments, the pendant stabilization device 610 may include a decorative element (not shown); may include a weight 624; may include multiple inner bearings (not shown); may include only an outer bearing 618, an inner bearing 619, and a supporting component 18 for supporting the bearings 618, 619; or may include a decorative element (not shown) in place of the pendant 612.

The outer bearing 618 may include a passage 620 therethrough that receives the inner bearing 619 containing the pendant 612. In one embodiment, the inner bearing 619 is received and retained within the passage 620 of the outer bearing 618 and includes a passage 622 therethrough that receives the pendant 612. In another embodiment, the pendant 612 is received and retained within the passage 620 of the outer bearing 618 and includes a passage therethrough (not shown) that receives the inner bearing 619. In yet another embodiment, the pendant 612 is received and retained within the passage 620 of the outer bearing 618 and includes a passage therein (not shown) that receives the inner bearing 619. Upon movement of the supporting component 18 with respect to the outer bearing 618, the inner bearing 619, the pendant 612, and/or the decorative element (not shown), the outer bearing 618 rotates opposite the inner bearing 619.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by any of the following claims are desired to be protected.

What is claimed is:

1. An apparatus, comprising:

a pendant;

a supporting component for supporting said pendant; and a bearing rotatably engaging said pendant, said bearing engaging said supporting component and rotating relative said pendant upon movement of said supporting component with respect to said pendant to maintain an alignment of said pendant, and wherein said bearing includes an outer bearing having a passage and an inner bearing having a passage, said inner bearing rotating opposite said outer bearing when said supporting component is moved with respect to said bearing and said pendant.

2. The apparatus of claim 1, wherein said pendant includes a passage, said bearing being retained within said passage.

3. The apparatus of claim 1, wherein said bearing and said pendant are monolithicly constructed.

4. The apparatus of claim 1, wherein said inner bearing is retained within said passage of said outer bearing and said pendant is retained within said passage of said inner bearing.

5. The apparatus of claim 1, wherein said inner bearing is retained within a passage of said pendant and said pendant is retained within said passage of said outer bearing.

6. The apparatus of claim 1, wherein said inner bearing is retained within said passage of said outer bearing and said outer bearing is retained within a passage of said pendant.

7. The apparatus of claim 1, wherein said inner bearing is retained within said passage of said outer bearing.

8. The apparatus of claim 1, wherein said bearing includes a plurality of inner bearings.

9. The apparatus of claim 1, wherein one of said bearing and said pendant have at least one decorative embellishment thereon.

10. The apparatus of claim 9, wherein said at least one decorative embellishment being selected from the group of decorative embellishments consisting of stones, crystals, jewels, plastic, metals, time pieces, glass, images, pictures, etchings, cloisonné, engraving, filigree, and vials containing liquids, powders, gems, and stones.

11. The apparatus of claim 1, wherein said supporting component is selected from the group of supporting components consisting of a chain, a cord, at least one strand, a rope, a ribbon, and a tie.

12. The apparatus of claim 1 further comprising a weight coupled with one of said bearing and said pendant to maintain the alignment of said pendant.

13. The apparatus of claim 1, wherein said bearing is coupled with said pendant.

14. An apparatus, comprising:

a first bearing having a passage;

a second bearing having a passage;

a supporting component for supporting said first bearing and said second bearing, said supporting component engaging one of said first bearing and said second bearing, said first bearing rotating opposite said second bearing upon movement of said supporting component with respect to said first bearing and said second bearing.

15. The apparatus of claim 14, wherein said first bearing is retained within said passage of said second bearing.

16. The apparatus of claim 15, wherein a pendant is retained within said passage of said first bearing.

17. The apparatus of claim 14, wherein said supporting component is selected from the group consisting of a chain, a cord, at least one strand, a rope, a ribbon, and a tie.

18. The apparatus of claim 14 further comprising a weight coupled with one of the first bearing and the second bearing.

19. The apparatus of claim 14, wherein at least one of the first bearing and the second bearing have at least one decorative embellishment thereon.

20. A method of stabilizing, comprising:

providing a pendant, a bearing that rotatably engages said pendant, and a supporting component that supports said pendant and said bearing, said supporting component engaging said bearing, wherein said bearing includes an inner bearing having a passage and an outer bearing having a passage, said inner bearing rotating opposite said outer bearing when said supporting component is moved with respect to said pendant and said bearing;

moving said supporting component with respect to said pendant and said bearing; and rotating said bearing with respect to said pendant to maintain an alignment of said pendant when said supporting component is moved with respect to said pendant and said bearing.

21. The method of claim 20 further comprising a weight to maintain alignment of said pendant.

22. The method of claim 20, wherein said supporting component is selected from the group of supporting components consisting of a chain, a cord, at least one strand, a rope, a ribbon, and a tie.

23. The method of claim 20, wherein said inner bearing is retained within a passage of said outer bearing.

24. The method of claim 20, wherein said inner bearing is retained within said passage of said outer bearing and said pendant is retained within said passage of said inner bearing.

25. The method of claim 20, wherein said inner bearing is retained within a passage of said pendant and said pendant is retained within said passage of said outer bearing.

26. The method of claim 20, wherein said inner bearing is retained within said passage of said outer bearing and said outer bearing is retained within a passage of said pendant.

27. The method of claim 20, wherein said bearing includes a plurality of inner bearings.

28. The method of claim 20, wherein said bearing is coupled with said pendant.

* * * * *